US005709457A

United States Patent [19]

Hara

[11] Patent Number: 5,709,457

[45] Date of Patent: Jan. 20, 1998

[54] DRAINING LAMP BASE/HUSK ASSEMBLY

[75] Inventor: Kanichi Hara, Kowloon, Hong Kong

[73] Assignee: Minami Internatinal Corp., Yonkers, N.Y.

[21] Appl. No.: 687,644

[22] Filed: Jul. 26, 1996

[51] Int. Cl.[6] ..... F21V 33/00

[52] U.S. Cl. ..... 362/96; 362/226; 362/294; 362/249

[58] Field of Search ..... 362/96, 226, 294, 362/373, 249; 439/194, 356, 611, 619

[56] References Cited

U.S. PATENT DOCUMENTS

| | | | |
|---|---|---|---|
| 1,873,291 | 8/1932 | Cole | 362/294 |
| 2,322,945 | 6/1943 | Liabastre | 362/294 |
| 4,159,157 | 6/1979 | Koehler | 362/194 |
| 4,999,751 | 3/1991 | Chen | 362/226 |
| 5,001,615 | 3/1991 | Stefanelli | 362/226 |
| 5,367,443 | 11/1994 | Hara | 362/227 |

*Primary Examiner*—Thomas M. Sember

*Attorney, Agent, or Firm*—Amster, Rothstein & Ebenstein

[57] ABSTRACT

A draining lamp base/husk assembly includes an elongate lamp base member and an elongate husk member configured and dimensioned to receive coaxially and telescopically therein (and to release therefrom) a portion of the lamp base member. A drainage passageway, integral in part with the lamp base member and in part with the husk member, enables the communication of liquid intermediate ends of the assembly when the members are in a coaxial and telescoped disposition. Preferably, the lamp base member defines an exterior longitudinally extending groove on an outer surface thereof, and the said husk member defines an interior longitudinally extending groove on an inner surface thereof. The exterior and interior longitudinally extending grooves are radially aligned and cooperatively define the drainage passageway over a common longitudinally extending length of the exterior and interior grooves.

7 Claims, 5 Drawing Sheets

DRAINING LAMP BASE/HUSK ASSEMBLY

BACKGROUND OF THE INVENTION

The present invention relates to miniature lights (such as Christmas tree lights) and, more particularly, to such lights providing liquid drainage.

Strings of small or miniature lights are commonly employed on Christmas trees and on various natural and artificial elements (such as living trees and roofs or windows) during festive or religious occasions. Typically a series of elongate husks are disposed in series, parallel or series-parallel relationship on one or more sets of electrical wires. Each husk is configured and dimensioned to releasably receive coaxially and telescopically therein at least a portion of an elongate lamp base and provide either steady or intermittent energization of a miniature lamp or bulb disposed in and secured to the lamp base. The lamp base is secured to the husk by either a rotational threaded screw type connection or by a non-rotational push-in friction fit or interference fit type connection. The present invention is directed primarily to the non-rotational or push-in type connection between the husk and lamp base.

Commonly owned U.S. Pat. No. 5,001,615 discloses such an assembly of an elongated lamp base and an elongate husk configured and dimensioned to receive coaxially and telescopically therein (and to release therefrom) a portion of the lamp base. The assembly is provided with a lug-and-locking element combination, integral in part with the lamp base and in part with the husk, for effecting a positive interlock of the lamp base and husk in a coaxially and telescoped disposition (and a release of such interlock). The positive interlock (and release) feature requires a manual movement independent of the manual movement required to effect receipt of the lamp base and the husk in a coaxially and telescoped disposition (or separation of the lamp base and husk therefrom). The present invention may be used in combination with such a positive interlock assembly, or modifications thereof which do not require a manual movement independent of the manual movement required to effect receipt or separation of the lamp base and husk, or, indeed, without any interlock at all.

Commonly assigned U.S. Pat. No. 5,367,443 discloses such a lamp base/husk assembly which is provided with special gripping means so that, once the lamp base has been inserted within the husk assembly, the lamp base tightly holds the lamp therein to preclude accidental rotation thereof relative to the base. The lamp base includes a body defining an outer surface, an open-top cavity configured and dimensioned to receive a portion of the lamp therein, and a cantilever projecting generally longitudinally from the body. The cantilever is movable between a releasing orientation and a locking orientation, the cantilever in the releasing orientation enabling little or limited relative rotation of the lamp and the base and in the locking orientation precluding such relative rotation. The cantilever is biased to the releasing orientation, but automatically assumes the locking orientation when the base is inserted into a holder. The present invention may be used in combination with such special gripping means, other gripping means or, indeed, without any gripping means at all.

The two above-identified commonly assigned patents are incorporated herein by reference as fully as if set forth herein. As illustrated in the aforementioned U.S. Pat. No. 5,367,443, both the positive interlock assembly and the lamp gripping feature may be utilized together, and, indeed, either, neither or both may be utilized in conjunction with the present invention as described below. The present invention is illustrated in the drawing as including the special gripping means.

When the conventional lamp base/husk assembly is used outdoors, it is subject to the possibility of rain falling and accumulating on the upper end thereof (the upper end being determined by whether the assembly is used in an upright or inverted orientation). Even when the assembly is used only indoors, there is still a possibility of water leakage from overhead pipes and the accumulation of water on the upper end thereof. While an accumulation of liquid on the upper surface on the husk, the lamp base or the interface thereof does not present a problem in and of itself, it increases the likelihood that the liquid will enter the interface between the lamp and the lamp base and, by chance, eventually contact the uninsulated dumet leads (extending from the lamp portion in the base cavity, through the base body, and onto the base body outer surface) or other exposed conductive elements.

Due to the constraints on the physical dimensions of a miniature light, it is simply not feasible to provide a fluid drainage passageway of adequate size extending from the top of the base member downwardly to and through the bottom of the base member or from the top of the husk member downwardly to and through the bottom of the husk member. Thus it is not feasible to have either component exclusively providing a drainage passageway therethrough, with that component precluding the escape of liquid from the drainage passageway into areas where the liquid might present a problem.

Accordingly, it is an object of the present to provide a lamp base/husk assembly which drains itself.

Another object is to provide such an assembly in which a drainage passageway is provided so as to direct liquid away from the exposed conductive elements thereof.

A further object is to provide such an assembly wherein the husk or lamp base thereof may be replaced by a conventional husk or a conventional lamp base to provide a new assembly having at least a limited degree of drainage.

SUMMARY OF THE INVENTION

It has now been found that the above and related objects are obtained in a draining lamp base/husk assembly. The assembly comprises an elongate lamp base member and an elongate husk member configured and dimensioned to receive coaxially and telescopically therein (and to release therefrom) a portion of the lamp base member. Means, integral in part with the lamp base member and in part with the husk member, are provided for enabling the communication of liquid intermediate ends of the assembly when the members are in a coaxial and telescoped disposition.

Preferably the assembly defines an upper end and a lower end, and the enabling means enables the communication of liquid from the upper end to and through the lower end under the influence of gravity. The enabling means preferably defines a vertical passageway between the ends of the assembly.

In a preferred first embodiment, the lamp base member defines an exterior longitudinally extending groove on an outer surface thereof and the husk member defines an interior longitudinally extending groove on an inner surface thereof. The exterior and interior longitudinally extending grooves are radially aligned and cooperatively define the enabling means over a common longitudinally extending length of the exterior and interior grooves. Preferably an upper portion of the lamp base member has a generally circular outer surface and defines the lamp base member groove on the outer surface, and an upper portion of the husk member has a generally oblong outer surface and defines the husk member groove on the inner surface. Visible aligning means may be provided on each of the members for determining radial alignment of the exterior and interior grooves. The enabling means defines a vertical passageway over the common length of the grooves.

In a second embodiment, the lamp base member defines an exterior longitudinally extending groove on an outer surface thereof which cooperatively defines the enabling means, with the groove-free inner surface of a standard or conventional miniature light husk member. In a third embodiment, the husk member defines an interior longitudinally extending groove on an inner surface thereof which cooperatively defines the enabling means, with the groove-free outer surface of a standard or conventional miniature light lamp base member.

BRIEF DESCRIPTION OF THE DRAWING

The above brief description, as well as further objects, features and advantages of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
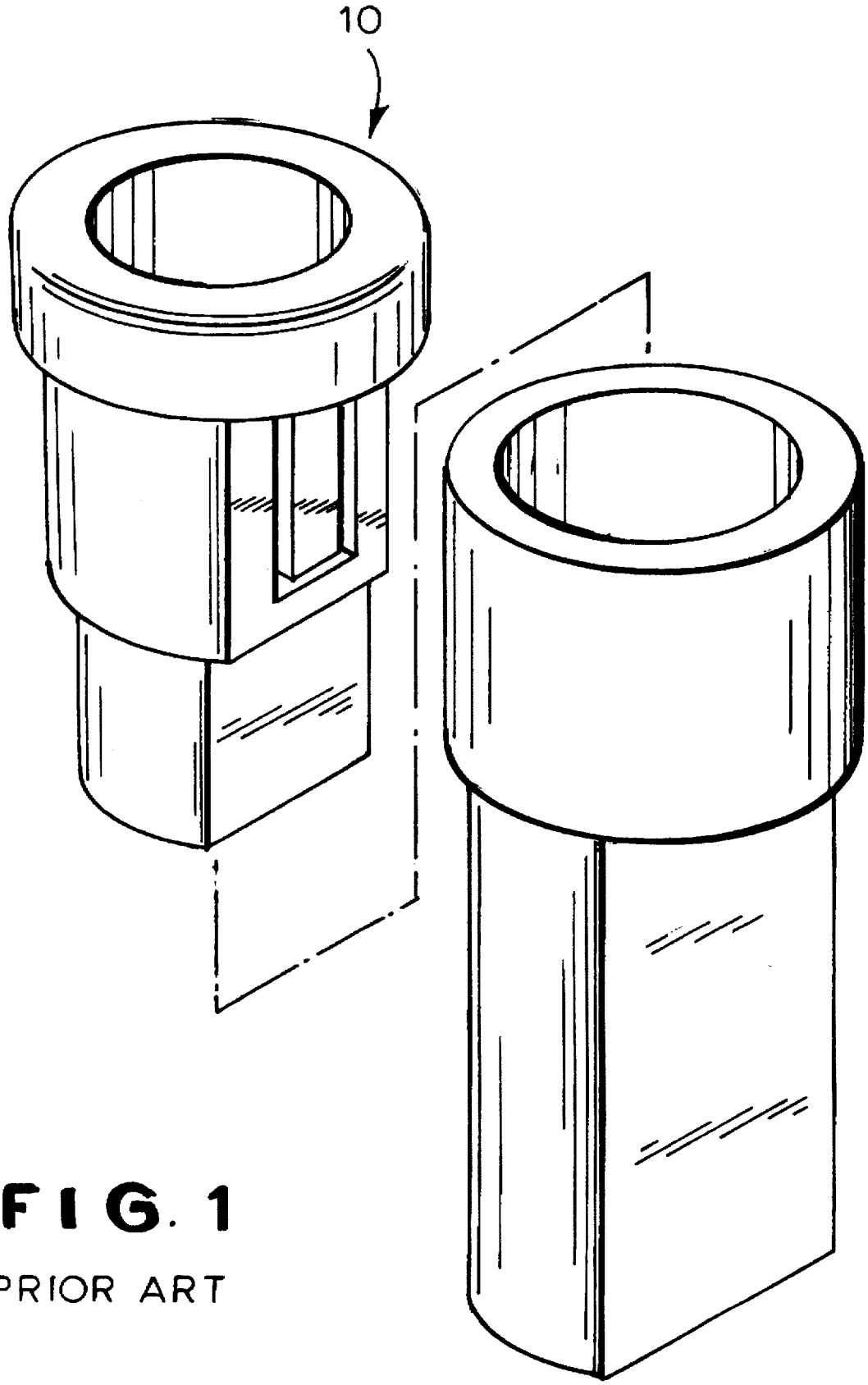
FIG. 1 PRIOR ART
FIG. 1 is an exploded isometric view of a first push-in lamp base/husk assembly according to the prior art in conjunction with a lamp.
Figure 2:
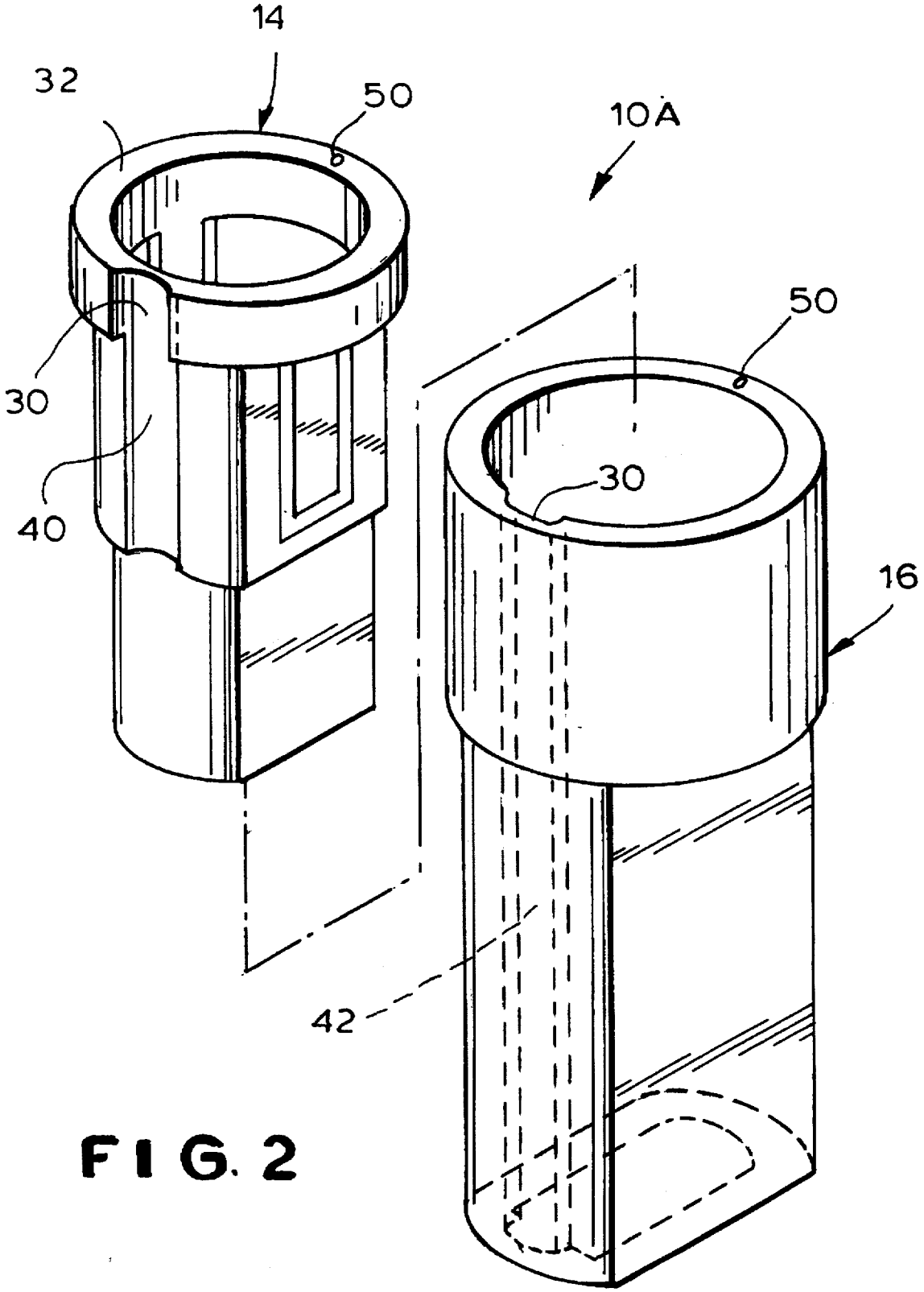
FIG. 2 is an exploded isometric view of a first push-in lamp base/husk assembly according to the present invention in conjunction with a lamp.

Referring now to the drawing, and in particular to FIG. 1 thereof, therein illustrated is an assembly according to the prior art, generally designated by the reference numeral 10. In its conventional aspects the assembly 10 comprises a lamp or bulb 12, a lamp base generally designated 14, and a husk generally designated 6. The lamp 12 and lamp base 14 together constitute a non-rotational push-in lamp/lamp base subassembly. The lamp base 14 includes a substantially rigid, electrically insulative, hollow elongate housing 24 defining an aperture 25 at the top thereof for partial receipt therein of the lamp 12 and a surrounding rim 23 extending over the top of the husk 16. The husk 16 includes a substantially rigid, electrically insulative, hollow elongate housing 26 defining an aperture 27 at the top thereof for partial receipt therein of the lamp base 14. As is conventional, the lamp base 14 contains openings therethrough for electrical contacts 28 from the lamp 12 for establishing electrical connection between the electrical circuit of the lamp 12 and the husk 16, while the husk 16 contains electrical contacts 29 for establishing electrical connection between the electrical contacts 28 of the lamp 12 and various electrical wires 20 connected to the husk 16 in series, parallel, or series-parallel configurations. The electrical aspects of the lamp 12 and husk 16 are conventional in nature and well known to those skilled in the miniature light art; accordingly, further details thereof are not set forth herein.

Turning now to the novel aspects of the present invention and referring now to FIGS. 2–5, in a first preferred embodiment 10A means, generally designated 30, are provided for enabling the safe drainage of liquid therethrough from the top of the assembly. The means 30 are integral in part with the lamp base 14 and in part with the husk 16, for enabling the communication of liquid intermediate ends of the assembly when the members 14, 16 are in a coaxially and telescoped disposition. More particularly, the assembly has an upper end (as illustrated the top surface 32 of the lamp base 12) and a lower end (as illustrated the bottom surface 34 of the husk 16). The enabling means 30 enables the communication of liquid from the upper end to and through the lower end under the influence of gravity. Where the assembly is in an inverted orientation, in which the upper end is the free end 34 of husk 16 and the lower end is the free end 32 of lamp base 14, the enabling means 30 still enables the safe communication of liquid from the upper end to and through the lower end under the influence of gravity. The enabling means 30 preferably defines a vertical passageway, 360° around, between the ends 32, 34 of the assembly 10A.

Figure 3:
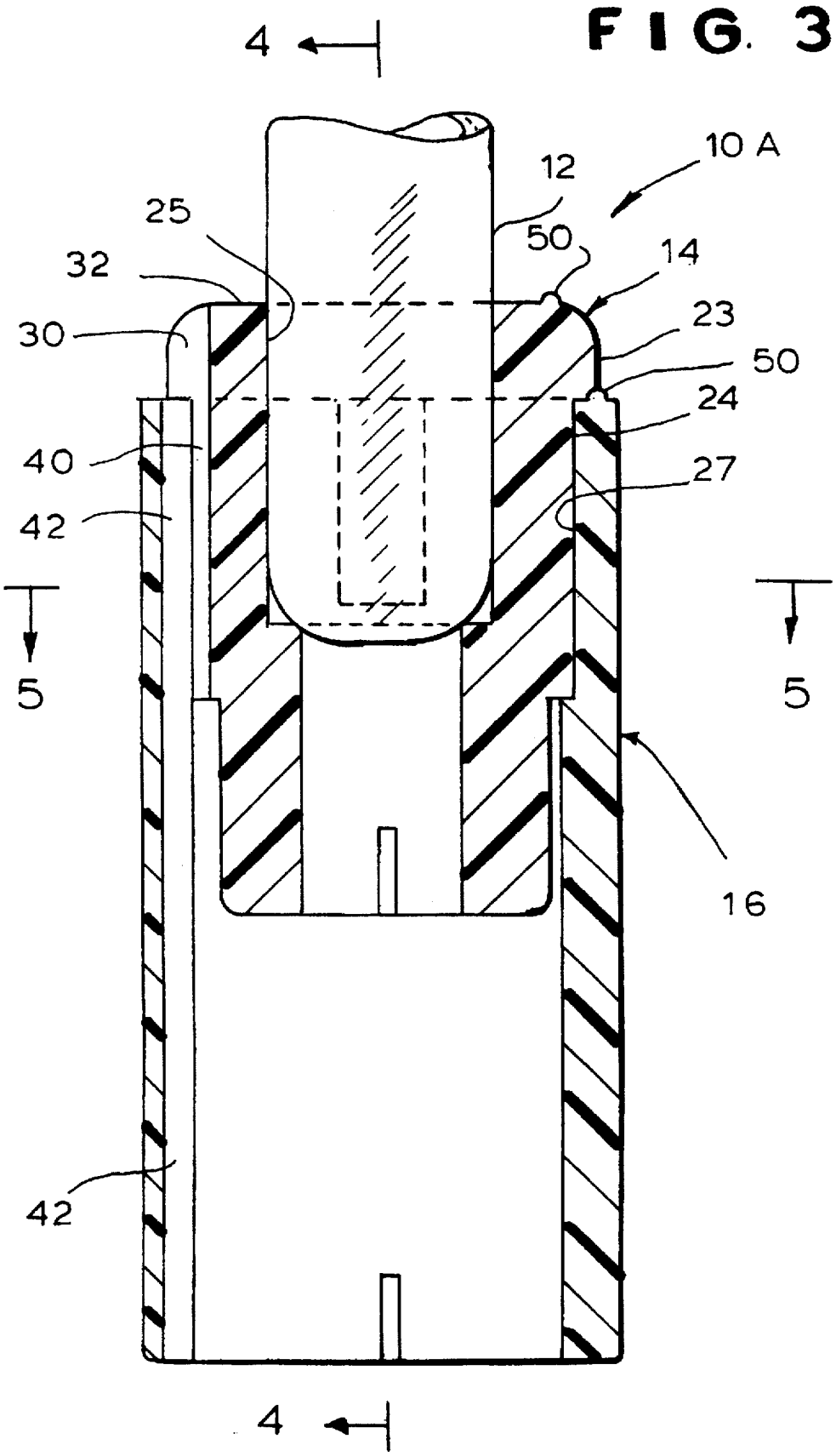
FIG. 3 is a fragmentary sectional view of the assembly.
Figure 4:
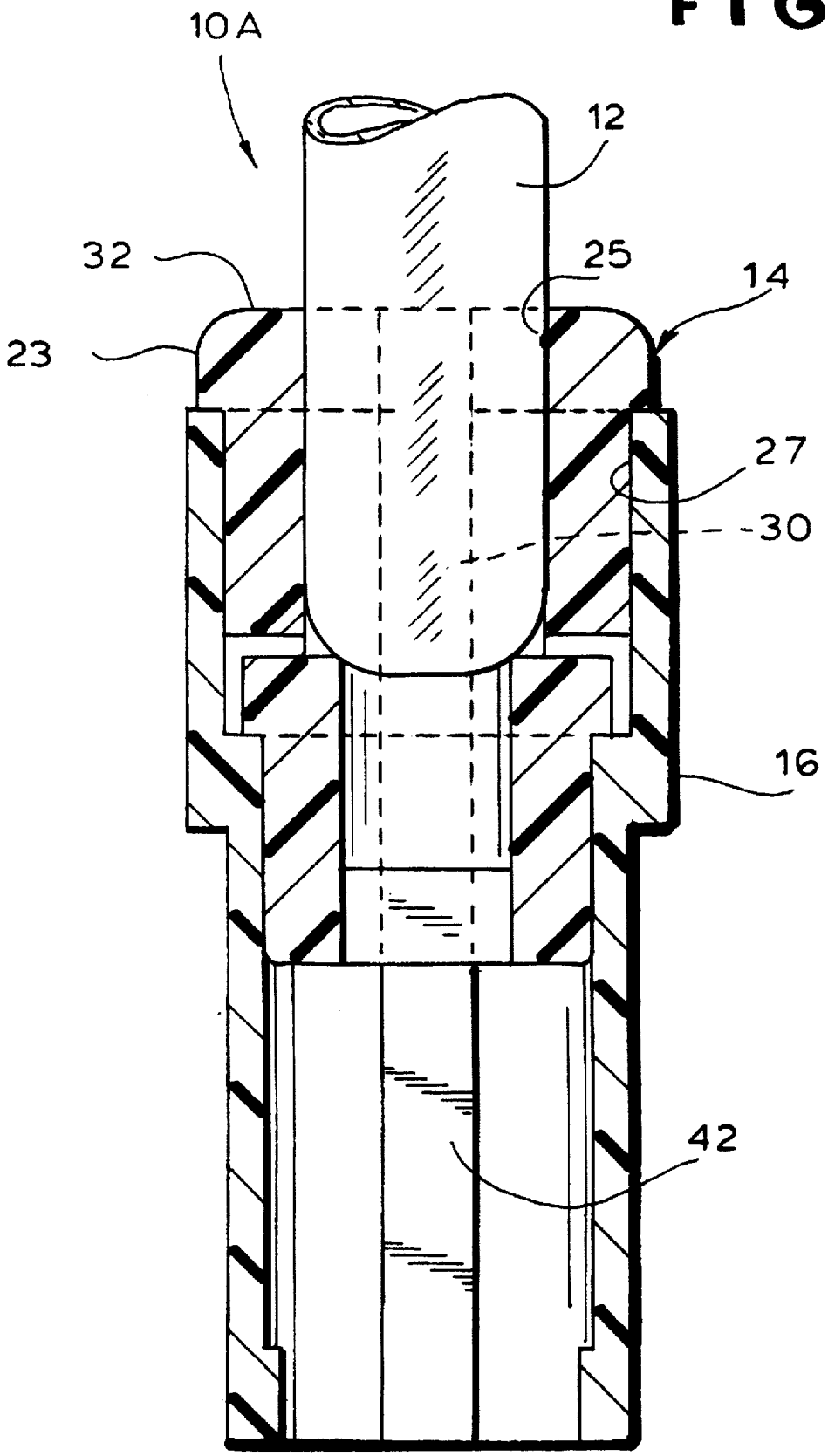
FIG. 4 is a fragmentary sectional view of the assembly rotated 90° from FIG. 3 and taken along the line 4—4 of FIG. 3.
Figure 5:
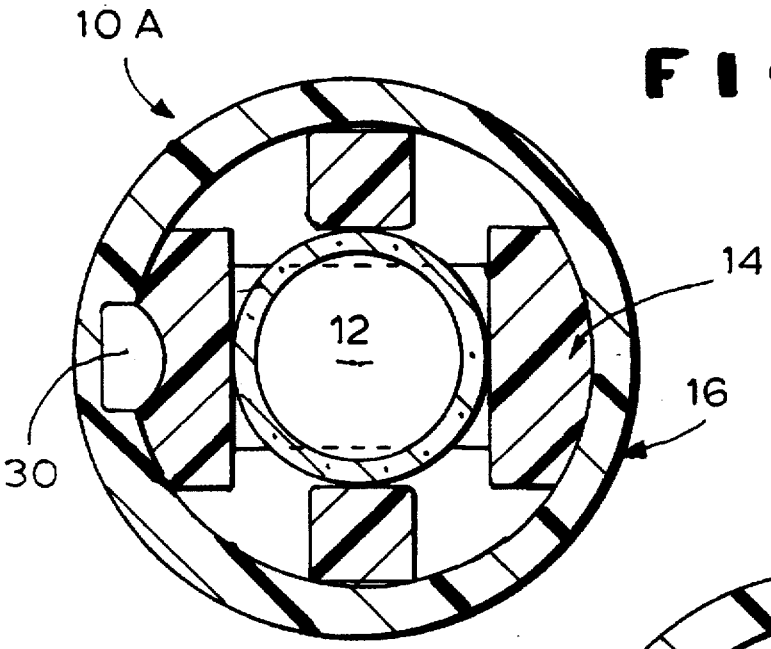
FIG. 5 is a top plan sectional view of the assembly taken along the line 5—5 of FIG. 3.

In the first preferred embodiment, the lamp base 14 defines an exterior longitudinally extending groove 40 on an exterior surface thereof, and the husk 16 defines an interior longitudinally extending groove 42 on an interior surface thereof. As best seen in FIGS. 3 and 5, the exterior and interior extending grooves 40,42 are radially aligned and cooperatively (that is, together) define the aforementioned enabling means 30 over a common, longitudinally extending length of the exterior and interior grooves 40, 42. More particularly, the upper portion of the lamp base 14 has a general circular outer surface and defines the longitudinally extending lamp base groove 40 on such outer surface (as an interruption of the generally circular outer surface). The upper portion of the husk 16 has a generally oblong outer surface and defines the longitudinally extending husk groove 42 on an inner surface thereof. The "oblong" configuration may be visualized as the result of an outward pulling of one side of the husk 16 to overcome the circularity thereof and provide room therein for interior groove 42 (although, of course, it is simply molded oblong).

The exterior groove 40 of lamp base 12 extends from the top surface 32, downwardly through the rim 33 and the housing 24, thereby resulting in some weakening of the lamp base 14. This weakening is of little concern since, once the lamp base 14 is inserted into the husk 16, the husk 16 provides additional strengthening of the lamp base 14. However, if the interior groove 42 of husk 16 extended from the top surface of the husk 16, downwardly through a circular husk housing, it would substantially weaken a husk 16 of miniature size. Accordingly, the husk 16 of the present invention is oblong so that substantially the same thickness of husk 16 extends 360 degrees around the lamp base 14 to provide support therefor. It will be appreciated that the slightly enlarged cross-sectional area of the oblong configuration is within the parameters for the acceptable dimensions of the miniature light and, indeed, need not even increase the size of the assembly as much as the positive interlock of U.S. Pat. No. 5,001,615.

As best illustrated in FIG. 3, the lamp base 14 is provided with a small raised dot 50, or other visible and/or tactile aligning indicia, e.g., on its top surface 32, and the husk 16 is provided with a small raised dot 50 or like indicia, e.g., on its top surface. When the two raised dots or like indicia 50 are in radial alignment, the person inserting the lamp base 14 into the husk 16 is assured that the exterior and interior grooves 40, 42 also are in radial alignment so that they define a vertical drainage passageway of adequate size extending over the common lengths of the grooves 40, 42. While the visible and tactile aligning means 50 may be used to determine the radial alignment of the exterior and interior grooves 40, 42 in a no-frills assembly, other means also may be employed. For example, if the assembly is provided with a positive interlock assembly as taught by U.S. Pat. No. 5,001,615, then the alignment of the lug of the husk and the locking element on the lamp base may be used to determine the appropriate alignment of the exterior and interior grooves 40, 42. Alternatively, the interior of the husk 16 and the exterior of the lamp base 14 may be provided with keys and keyways, as taught in U.S. Pat. No. 5,367,443, such that assembly of the lamp base and the husk is possible only when they are in a given relative rotational orientation.

(It will be understood that the reference to an "interior" groove 42 on the husk 16 is not to be taken as implying that the groove 42 is defined, 360° around, by a closely adjacent surface of the husk 16. Indeed, neither the exterior groove 40 nor the interior groove 42 defines by itself a passageway, but, rather, each groove defines only a partial passageway, less than 360° around.)

The preferred embodiment 10A described above and illustrated in FIGS. 2–5 provides an enabling means or drainage passageway 30 which is of greater cross sectional area then would be possible if the passageway were to be contained solely within one or the other of the components 14, 16 of the assembly. The effective cross sectional area of the passageway 30 is the sum of the cross sectional areas of the exterior and interior grooves 40,42 when placed open face-to-open face. Such a summed cross sectional area provides more than adequate drainage for most indoor and outdoor applications.

Nonetheless, the preferred embodiment described above presents certain drawbacks. First, manufacture of the preferred embodiment requires modification of both the lamp base mold and the husk mold. The former must be provided with an exterior groove 40, and the latter must be made oblong and provided with an interior groove 42. This increases the start-up cost for manufacturing the preferred embodiment. Second, people who purchase the preferred embodiment may eventually have a lamp 12 thereof go bad (e.g., blow out) and wish to substitute for the bad lamp a conventional replacement lamp/lamp base subassembly 12/14 previously purchased. Third, people who have conventional lighting sets with the conventional husks may purchase lamp/lamp base subassemblies 12/14 of the new type and wish to use these new subassemblies as replacements in the old husks 16. Finally, people who purchase lighting sets of the preferred embodiment and already have lighting sets of conventional design may accidentally utilize a preferred embodiment lamp base with a conventional husk or a conventional lamp/lamp base subassembly with a preferred embodiment husk.

Figure 6:
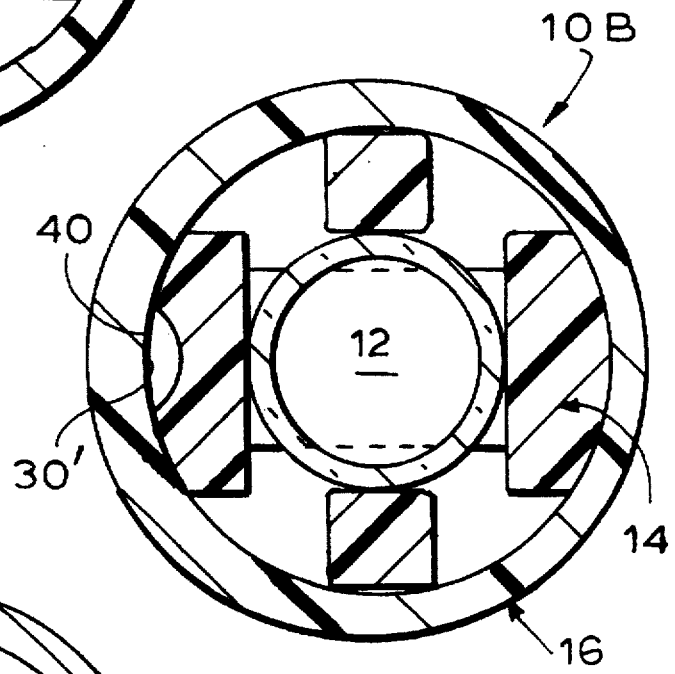
FIG. 6 is a top plan sectional view similar to FIG. 5, but of a second assembly according to the present invention formed by a lamp base according to the present invention in conjunction with a conventional husk.

Accordingly, referring now to FIG. 6, the present invention also encompasses, as a second embodiment, an assembly 10B wherein the lamp base 14 defines an exterior longitudinally extending groove 40 on an outer surface thereof which cooperatively defines the enabling means 30' with the groove-free inner surface of a standard miniature light husk 16'. In this instance, the vertically extending passageway or enabling means 30', defined by the exterior groove 40 on one side and the standard groove-free inner surface of a standard or conventional husk 16' on the other side, has a lesser cross-sectional area available for fluid drainage than the passageway 30 of the preferred embodiment.

Figure 7:
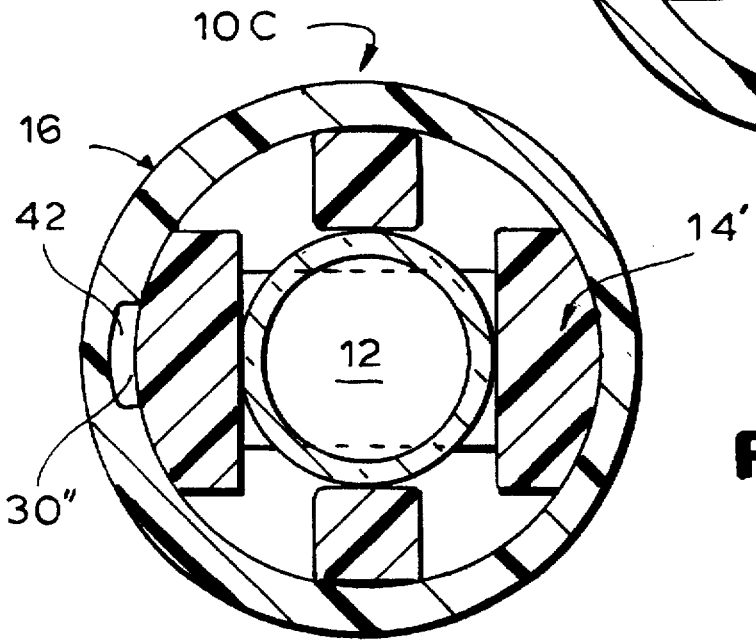
FIG. 7 is a top plan sectional view similar to FIG. 5, but of an assembly according to the present invention formed by a husk according to the present invention in combination with a conventional lamp base.

Referring now to FIG. 7, the present invention also encompasses, as a third embodiment 10C, an assembly wherein the husk 16 defines an interior longitudinally extending groove 42 on an inner surface thereof which cooperatively defines the enabling means 30" with the groove-free outer surface of a standard or conventional miniature light base 14'. In this instance, the vertically extending passageway or enabling means 30", defined by the interior groove 42 on one side and the groove-free outer surface of the lamp base 14' on the other side, has a lesser cross-sectional area available for fluid drainage than the passageway 30 of the preferred embodiment. In the first instance the passageway is somewhat "D" shaped, and in the other instance it is somewhat reverse "D" shaped. In any case the cross sectional area of the passageway 30', 30" of the second or third embodiment 10B or 10C is about equal to the cross sectional area of the groove 40 or 42, respectively, by itself. Under the normal circumstances encountered in many applications, this reduced-area passageway affords sufficient drainage.

To summarize, the present invention provides a lamp base/husk assembly which drains itself using a drainage passageway which directs liquid away from the exposed conductive elements thereof. Either the husk or lamp base thereof may be replaced by a conventional husk or a conventional lamp base, respectively, to provide a new assembly having at least a limited degree of drainage.

Now that the preferred embodiments of the present invention have been shown and described in detail, various modifications and improvements thereon will become readily apparent to those skilled in the art. Accordingly, the spirit and scope of the present invention is to be construed broadly and limited only by the appending claims, and not by the foregoing specification.

I claim:

1. A draining lamp base/husk assembly comprising:

(A) an elongate lamp base member defining an exterior longitudinally extending groove on an outer surface thereof;

(B) an elongate husk member configured and dimensioned to receive coaxially and telescopically therein and to release therefrom a portion of said lamp base member, said husk member defining an interior longitudinally extending groove on an inner surface thereof; and (C) means, integral in part with said lamp base member and in part with said husk member, for enabling a communication of liquid intermediate ends of said assembly when said members are in a coaxial and telescoped disposition, said exterior and interior longitudinally extending grooves being radially aligned and cooperatively defining said enabling means over a common longitudinally extending length of said exterior and interior grooves.

2. The assembly of claim 1 wherein an upper portion of said lamp base member has a generally circular outer surface and defines said lamp base member groove on said outer surface, and an upper portion of said husk member has a generally oblong outer surface and defines said husk member groove on said inner surface.

3. The assembly of claim 1 additionally including visible aligning means on each of said members for determining radial alignment of said exterior and interior grooves.

4. The assembly of claim 1 wherein said enabling means defines a vertical passageway over the common length of said grooves.

5. A draining lamp base/husk assembly comprising:

(A) an elongate lamp base member;

(B) an elongate husk member configured and dimensioned to receive coaxially and telescopically therein and to release therefrom a portion of said lamp base member; and (C) means, integral in part with said lamp base member and in part with said husk member, for enabling a communication of liquid intermediate ends of said assembly when said members are in a coaxial and telescoped disposition, said husk member defining an interior longitudinally extending groove on an inner surface thereof which cooperatively defines, with a groove-free outer surface of a standard miniature light lamp base member, said enabling means.

6. A draining lamp base/husk assembly having an upper end and a lower end, comprising:

(A) an elongate lamp base member defining an exterior longitudinally extending groove on an outer surface thereof;

(B) an elongate husk member defining an interior longitudinally extending groove on an inner surface thereof and being configured and dimensioned to receive coaxially and telescopically therein and to release therefrom a portion of said lamp base member; and (C) means, integral in part with said lamp base member and in part with said husk member, for enabling a communication of liquid intermediate ends of said assembly when said members are in a coaxial and telescoped disposition, said enabling means defining a vertical passageway and enabling a communication of water from said upper end to and through said lower end under the influence of gravity, said exterior and interior longitudinally extending grooves being radially aligned and cooperatively defining said enabling means over a common longitudinally extending length of said exterior and interior grooves.

7. The assembly of claim 6 wherein an upper portion of said lamp base member has a generally circular outer surface and defines said-lamp base member groove on said outer surface, and an upper portion of said husk member has a generally oblong outer surface and defines said husk member groove on said inner surface, said enabling means defining the vertical passageway over the common length of said grooves.

* * * * *

US005709457B1

REEXAMINATION CERTIFICATE (4104th)

United States Patent [19] [11] B1 5,709,457

Hara [45] Certificate Issued Jun. 20, 2000

[54] DRAINING LAMP BASE/HUSK ASSEMBLY

[75] Inventor: Kanichi Hara, Kowloon, The Hong Kong Special Administrative Region of the People's Republic of China

[73] Assignee: Minami International Corp., Yonkers, N.Y.

Reexamination Request:
No. 90/005,038, Jul. 13, 1998

Reexamination Certificate for:

| | |
|---|---|
| Patent No.: | **5,709,457** |
| Issued: | **Jan. 20, 1998** |
| Appl. No.: | **08/687,644** |
| Filed: | **Jul. 26, 1996** |

[51] Int. Cl.[7] ..... F21V 33/00

[52] U.S. Cl. ..... 362/96; 362/226; 362/294; 362/249

[58] Field of Search ..... 362/96, 226, 294, 362/373, 249; 439/194, 356, 611, 619

[56] References Cited

U.S. PATENT DOCUMENTS 5,722,771 3/1998 Wang .

*Primary Examiner*—Thomas M. Sember

[57] ABSTRACT

A draining lamp base/husk assembly includes an elongate lamp base member and an elongate husk member configured and dimensioned to receive coaxially and telescopically therein (and to release therefrom) a portion of the lamp base member. A drainage passageway, integral in part with the lamp base member and in part with the husk member, enables the communication of liquid intermediate ends of the assembly when the members are in a coaxial and telescoped disposition. Preferably, the lamp base member defines an exterior longitudinally extending groove on an outer surface thereof, and the said husk member defines an interior longitudinally extending groove on an inner surface thereof. The exterior and interior longitudinally extending grooves are radially aligned and cooperatively define the drainage passageway over a common longitudinally extending length of the exterior and interior grooves.

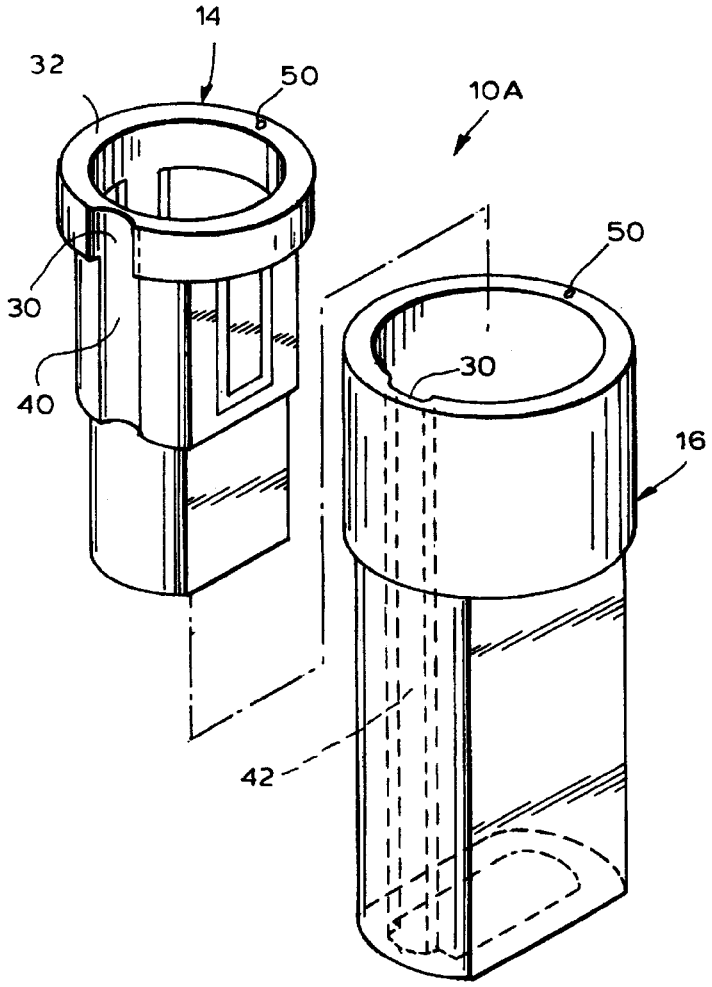

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *